US005806677A

United States Patent [19]

Storti

[11] Patent Number: 5,806,677

[45] Date of Patent: Sep. 15, 1998

[54] DOUBLE-POCKETED ARTICLE FOR CONTAINING PHOTOS, PRINTS AND THE LIKE

[75] Inventor: Fabrizio Storti, Recoaro Terme, Italy

[73] Assignee: Siral S.r.l., Vladagno, Italy

[21] Appl. No.: 931,100

[22] Filed: Sep. 15, 1997

[30] Foreign Application Priority Data

Sep. 16, 1996 [IT] Italy ..... VI96 A 000147

[51] Int. Cl.[6] ..... B65D 85/00

[52] U.S. Cl. ..... 206/425; 206/455

[58] Field of Search ..... 206/454, 455, 206/456, 425, 775, 776, 778, 782

[56] References Cited

U.S. PATENT DOCUMENTS 4,848,576 7/1989 Stemmer, Jr. ..... 206/455 X 5,431,449 7/1995 Arimoto et al. ..... 206/455 X

*Primary Examiner*—Jacob K. Ackun

*Attorney, Agent, or Firm*—Bucknam and Archer

[57] ABSTRACT

A double-pocketed article for containing photos, prints and the like which is characterized by the fact that it has a body (1) made of of three layers: two external layers (2, 3) made with a flexible transparent film, and a middle layer (4) made with a film of a rigid or semi-rigid material, such layers being joined to each other by means of welded seams (5), so as to form two pockets (6', 6") inside which the photos and prints are inserted (7' and 7") back-to-back.

12 Claims, 4 Drawing Sheets

DOUBLE-POCKETED ARTICLE FOR CONTAINING PHOTOS, PRINTS AND THE LIKE

FIELD OF THE INVENTION

This invention relates to the creation of an article able to contain photographs, prints and other similar materials, formed in a way that makes two overlaying pockets, allowing for the quick and easy insertion of two photos, prints or other similar materials contemporaneously and back-to-back.

BACKGROUND OF THE PRIOR ART

Well known for quite some time is the use of booklets that are distributed for advertising purposes by photo shops and contain the photos that are developed in such shops or in external developing laboratories.

Normally, such folders are made up of a cover in a rigid or semi-rigid material inside which there is a collection of envelopes of a transparent material, arranged like the pages of a book and made up of pockets where one or two photos can be placed touching each other back-to-back.

These folders, however, although allowing for an excellent preservation and presentation of the photos inserted in each pocket, do present some drawbacks which arise primarily while the photos are being inserted into the pockets of these folders.

In particular, the insertion of the photos into the pockets is made difficult by the electrostatic charge created between the plastic material of the pocket and the shiny surface of the photograph or print, which hinders the quick positioning of the above-mentioned photos into such pockets.

Moreover, to reduce the cost of the folders, each pocket is made of a transparent plastic film, which, besides being very thin, has the drawback that the two sides which make up the pocket tend to stick to each other, resulting in the difficulty in separating the two edges of the pockets, which can at times cause the entire envelope to crease, thus compromising the look of the photographs or prints placed inside them.

Because of such drawbacks, a mechanized system of inserting the photos into the pockets has not yet been possible, and for this reason the insertion normally occurs manually, by the customer, who receives from the photo shop the negatives, photos contained in a single paper envelope and the plastic booklet separately.

Finally, such booklets, supplied free by photo shops, contain a fixed number of pockets which rarely corresponds to the actual number of photos printed, and very frequently, such pockets are left unused, resulting in a considerable waste of material.

SUMMARY OF THE INVENTION

The object of this invention is to provide a booklet for containing photos, prints and other similar materials without the disadvantages listed above, and in particular, while using low-cost materials, can allow for easy and rapid insertion, not only by hand, but above all by means of automatic machines, installed directly in printing and developing laboratories.

In this way, the photo shop can give the customer the developed photos already inserted into the folder and arranged in the exact order that results from the roll of film, thus eliminating the usual method that has to be done by the customers themselves.

This is done by providing that the pocket article for containing two photographs arranged back-to-back be made up of two overlaying pockets made of three layers of plastic material.

The two external layers, in a transparent plastic material, form the external surfaces of the pockets, whereas the internal middle layer acts as a main support for these pockets.

The two external layers are made of a very thin transparent film, of the type used in the normal folders, whereas the middle layer is made of a transparent and opaque plastic material, which is advantageously more rigid than the two external layers and, above all, does not create an electrostatic charge when in contact with either the above-mentioned layers or the surface of the photo, which makes the system of insertion quicker and easier.

The three layers are joined along three edges, whereas the borders of the fourth edge remain free to allow for the insertion of the photos or prints into the overlaying pockets.

A constructive modification provides that the two external layers of transparent film are to be made of the two halves of a single-folded film for which welded seams are necessary only for delimiting each pocket in a series.

A further novel feature is the fact that the middle layer is wider than the other two external layers of equal width to each other, with the consequence that it creates a protruding flap which can have a number of advantageous functions.

The first function of this flap protruding laterally from the pocket article is that it acts as a binding edge, where one can, if desired, attach a folder like a book, i.e., when the pocket articles are joined with metallic means, adhesive or other types of binding means.

A second function of the above-mentioned laterally protruding border is that of supporting the holes that allow the pocket articles to be inserted into a container equipped with hooks, rings, spirals or other similar means to make a typical loose-leaf binder possible.

A third function of the above-mentioned laterally protruding border, when this is placed in correspondence with the borders and open edges, is that of allowing an easy insertion of photos and prints in the corresponding pockets since it provides a sufficiently rigid support on which the photos and prints can slide easily when inserted, as well as maintaining the above-mentioned photos separate when they are inserted, which provides rapid and safe insertion even with the opposite operation, i.e. the removal of the above-mentioned photos from the respective pockets.

Moreover, on such protruding borders arrows can be added that indicate the viewing direction of the photos very useful, in particular if the single pocket articles are joined in such a way as to form the typical accordion configuration.

Furthermore, some areas can be defined on these laterally protruding borders where the date, the place and other references that are noted, which identify the corresponding photo or print.

Finally, when the pocket articles of this invention form a continuous band, wound up in a reel which advances intermittently, and after the mechanical insertion operation, are subdivided into predetermined parts including one or more of the above-mentioned pocket articles, indications are stamped onto the laterally protruding border for the exact position of the pockets in correspondence to the photo feeders and for the action of the cutter that separates the part of the band already filled from the empty one.

BRIEF DESCRIPTION OF THE DRAWINGS

These and other characteristics of the invention will be further evidenced by means of the description of a possible form of construction intended only as an illustrative example and not limited to this description by reference of the attached figures where:

As shown in FIGS. 1 and 2, every pocket 1 is substantially made up of three layers 2, 3 and 4.

Figure 2:
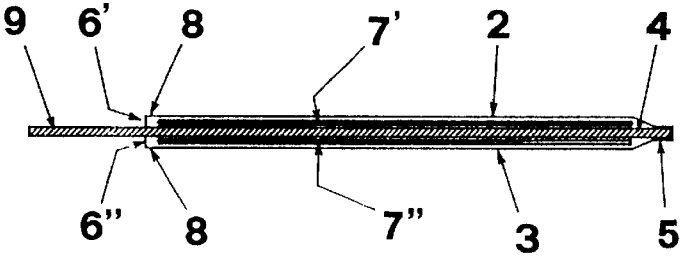
FIG. 2 is a cross-sectional view, in accordance with the line II—II of FIG. 1 of the pocket of the above-mentioned figure.
Figure 1:
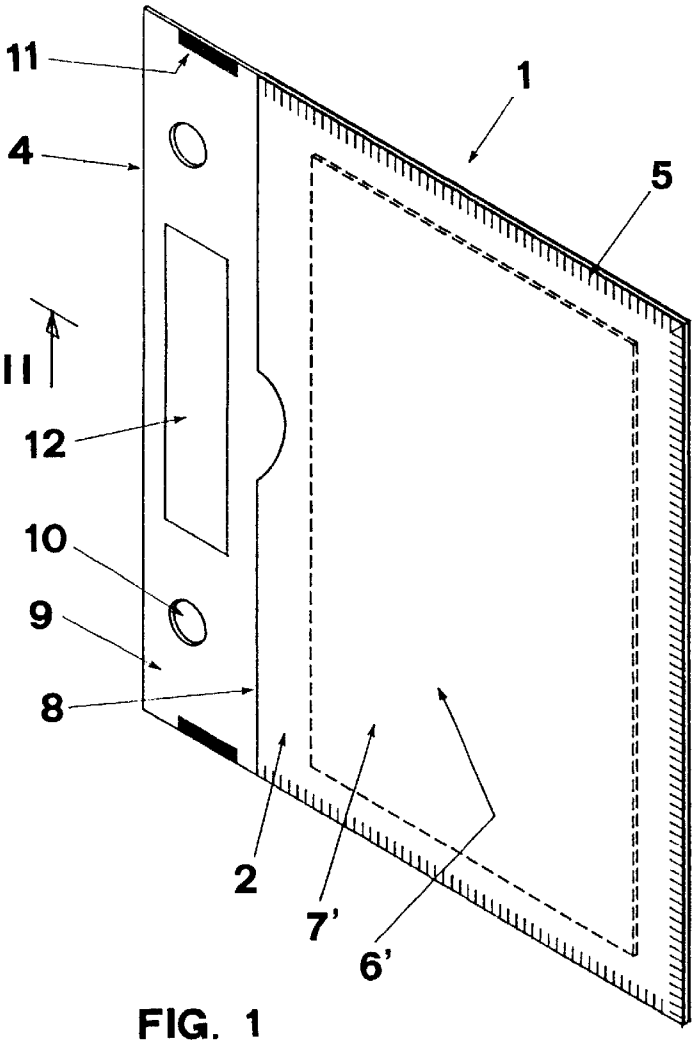
FIG. 1 shows a perspective view of a single pocket of the invention.

These three layers are joined on three sides, by means of the welded seams 5, so as to form the two pockets 6' and 6" (referred to below simply as 6), within which the photos or prints are inserted 7' and 7" (referred to below simply as 7) through the side which shows the borders 8 and the two external layers 2 and 3 free and only resting on the middle layer 4.

One novel feature of the invention resides in the fact that the middle layer 4, unlike the two external layers 2 and 3 which are made of a very thin transparent plastic film to allow one to view the photos arranged back-to-back, is made of a transparent and opaque film, which is rigid enough to hinder any creasing during the process of mechanical insertion.

Moreover, the middle layer 4, is advantageously wider than the two external layers 2 and 3, so as to make a protruding border 9 on which loopholes 10 can be placed for use with a ring binder, as well as indicators 11 for the exact positioning of the pocket 1 during the process of mechanical insertion, or surface areas 12 in which the photo or print identification data 7 can be written for the corresponding pocket 6.

Figure 4:
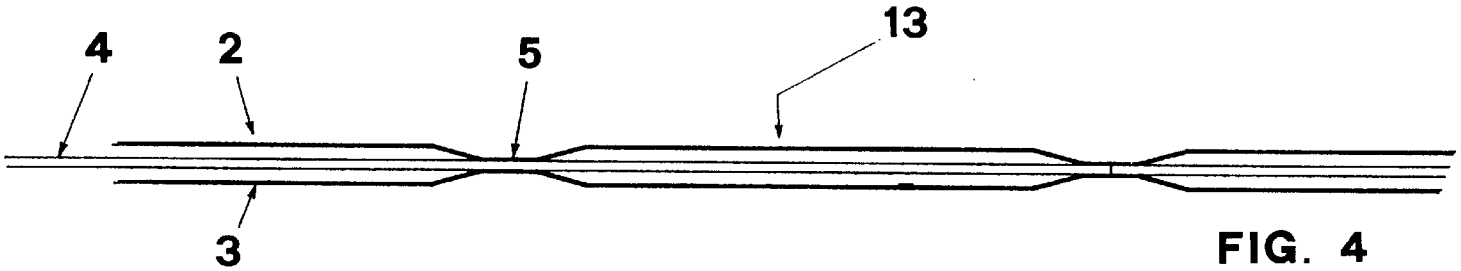
FIG. 4 represents a side view of the continuous band of FIG. 3.
Figure 3:
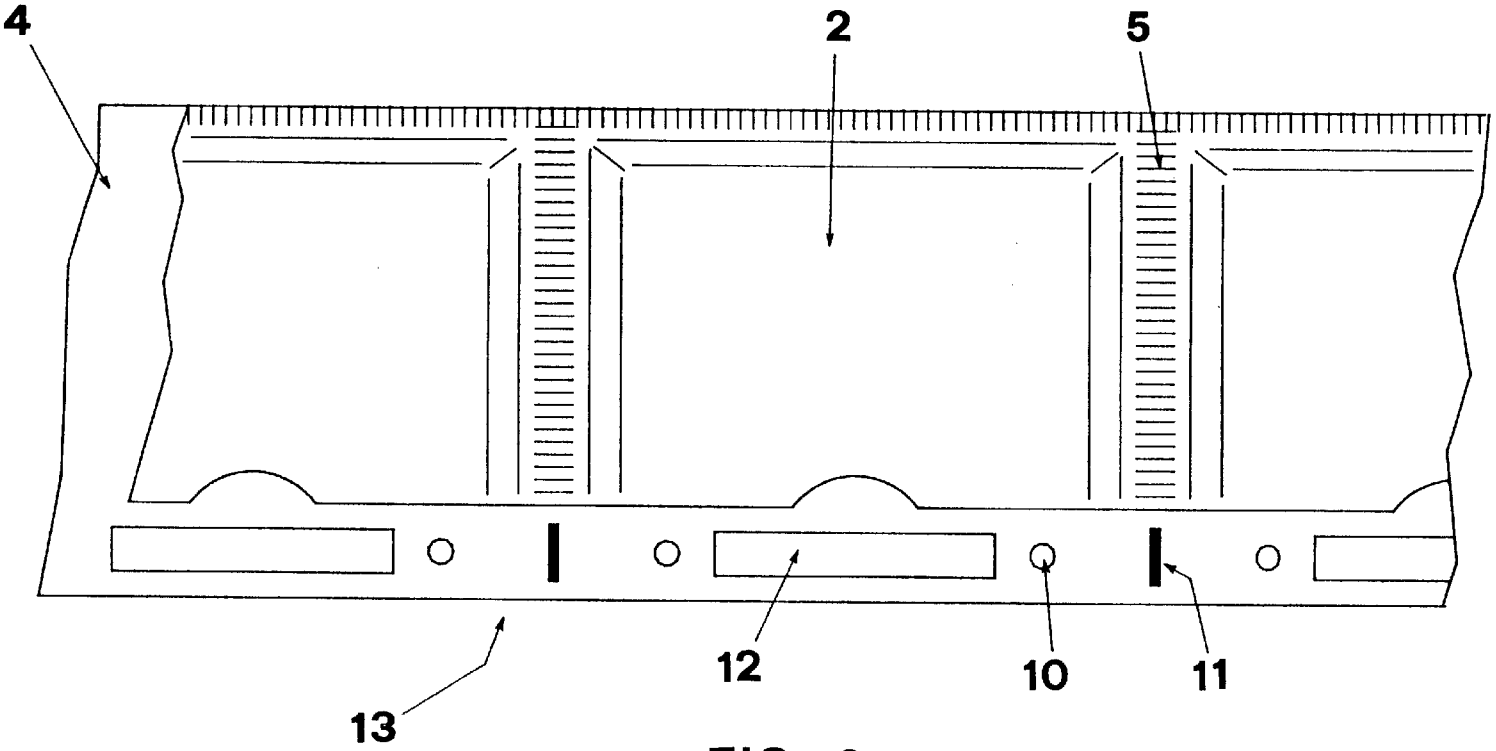
FIG. 3 represents a top view of several pockets of the invention, forming a continuous band.
Figure 5:
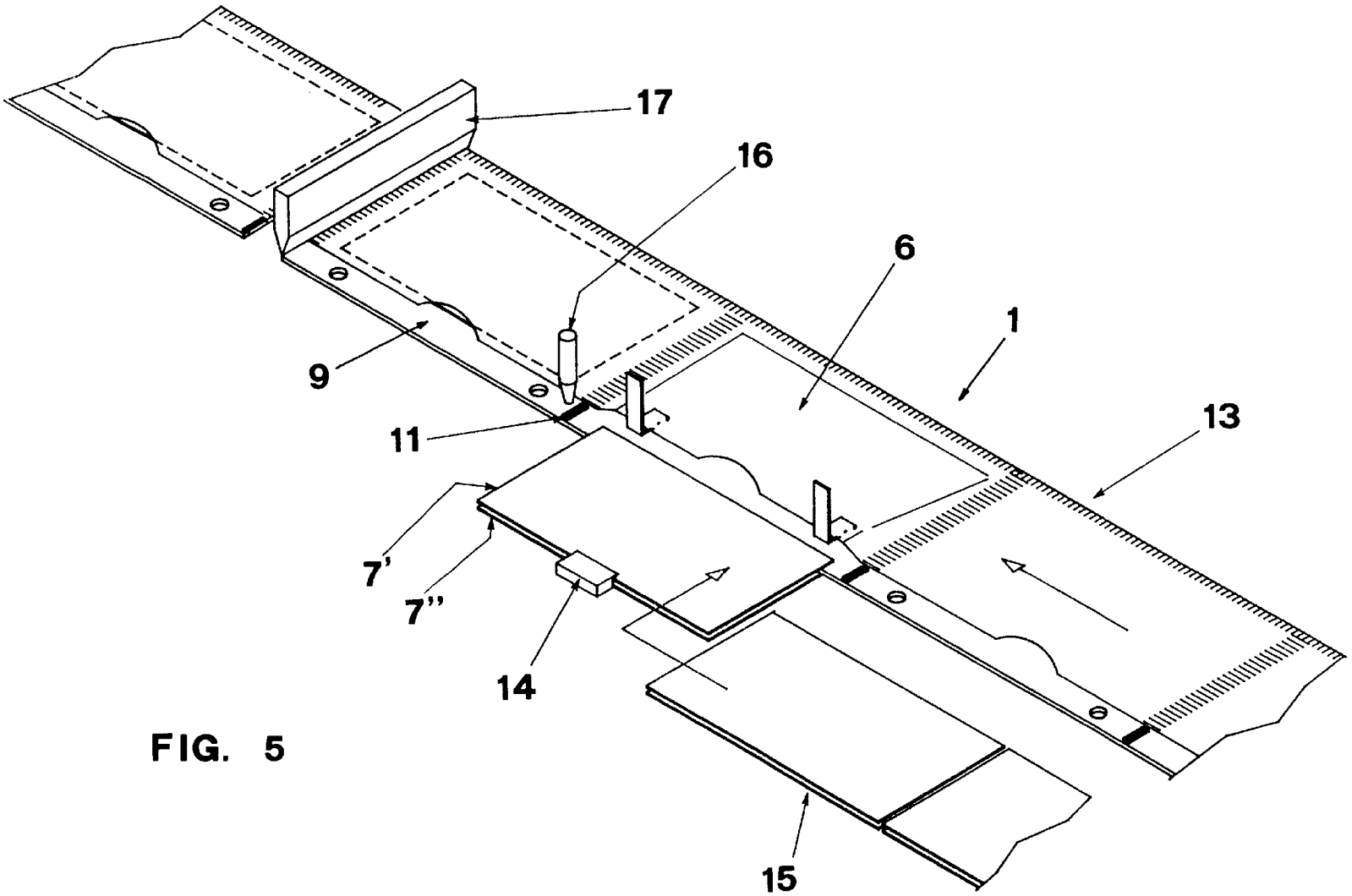
FIG. 5 represents a schematic view of the mechanical insertion procedure.

The single pockets 1 are stored as a continuous band 13 (see FIGS. 3 and 4) generally wound up in a reel that advances intermittently for the mechanical operation of insertion, schematically represented in FIG. 5, which does not form part of this invention.

Figure 7:
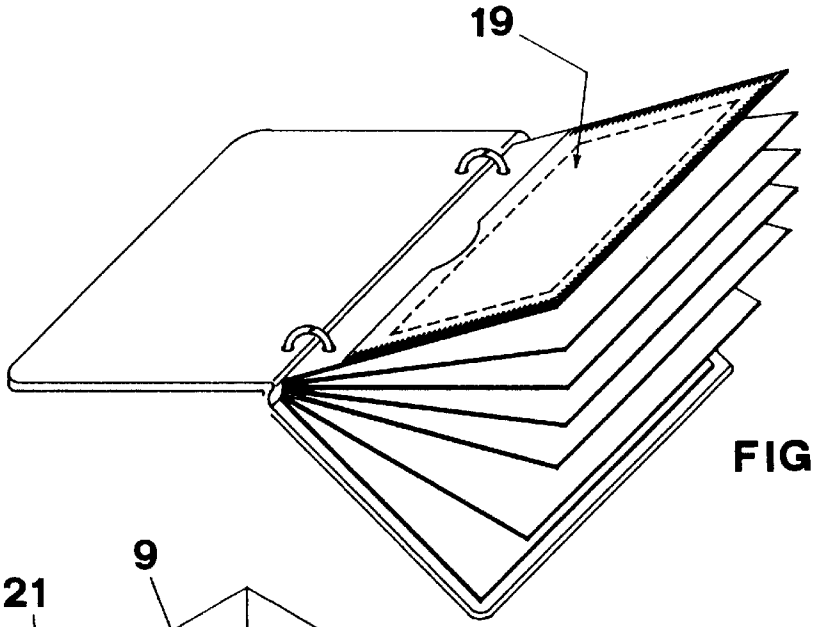
FIG. 7 represents the single-sheet binder packaging of the pockets of the invention.
Figure 8:
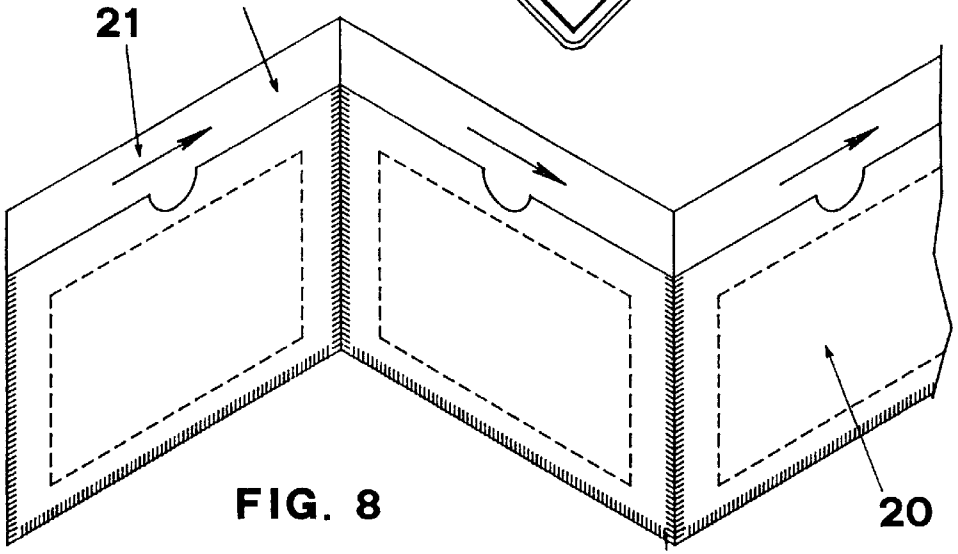
FIG. 8 represents an accordion configuration of the pockets of the invention.
Figure 6:
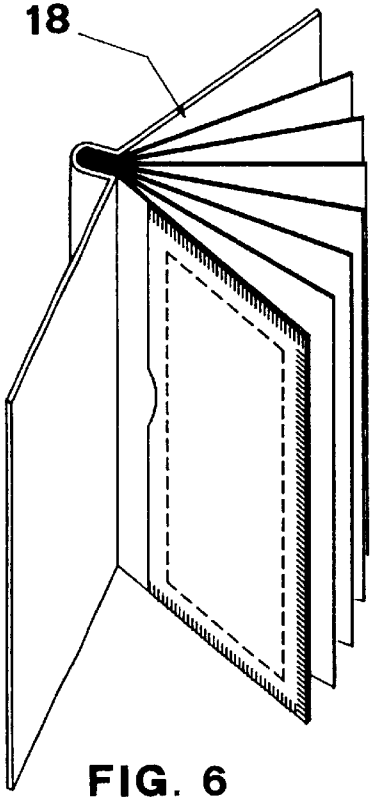
FIG. 6 represents the book packaging of the pockets of the invention.

As can be seen in this Figure, the continuous band 13 advances intermittently so as to allow a feeder 14 to take the photos 7 from storage and to insert them, arranged in pairs and back-to-back, within the two pockets 6 of every article 1. This is regulated by an optical scanner 16 which reads the positions of the indicators 11 and which also commands the action of the final cutter 17 which makes pocket 1 groups which can be inserted into ring binders 19, bound like a book 18, or simply folded like an accordion 20, as represented in the corresponding FIGS. 6, 7 and 8.

In this last arrangement 20 some arrows 21 are advantageously printed on the protruding border 9 and which indicate the exact progression in which to view the photos.

What is claimed is:

1. A double-pocketed article for containing photos, prints and the like, characterized by the fact that it has a body (1), made up of three layers: two external layers (2), (3) made of a flexible transparent film with a middle layer (4), said middle layer being of a film of a rigid or semi-rigid material, said layers (2), (3) and (4) being mutually united by means of welded seams (5), whereby two overlaying pockets (6', 6") are formed, said pockets having an interior, two photos or prints being inserted (7', 7") in said interior and being arranged back-to-back; said middle layer (4) being wider than said two external layers (2), (3) creating a laterally protruding edge (9), said edge acting as a separator of the above-mentioned photos or prints that have been inserted.

2. The article according to claim 1, characterized by the fact that said layers (2), (3) and (4) have sides, and the welded seams (5) join only three sides so that the edges (8) of said two external layers (2), (3) remain free to allow the insertion of said photos or prints (7) in the corresponding pocket (6).

3. The article according to claim 1, characterized by the fact that the two external layers (2), (3) are made with the edges of a single folded band.

4. The article according to claim 1, wherein said protruding edge (9) has loopholes (10) for use with a ring binder (19).

5. The article according to claim 1, wherein said protruding edge (9) forms the bookbinding border of a book-style binder (18).

6. The article according to claim 1, wherein said protruding edge (9) has indicators stamped on it (11), said indicators being recognized by optical scanners (16) which control the mechanical insertion process.

7. The article according to claim 1, wherein on said protruding edge (9) some surfaces (12) are defined in which some informative notes with respect to the photo or print inserted into the corresponding pocket (6) are printed.

8. The article according to claim 1, wherein on said protruding edge (9) some arrows (21) are printed, said arrows indicating the exact progression for viewing the photos (7).

9. The article according to claim 2, wherein said laterally protruding edge (9) is placed in correspondence to said free edges (8) and said edge (9) acts as the support of the photos during the insertion process.

10. The article according to claim 1, which is stored, while still empty, whereby it forms a continuous band (13) which can be wound onto a reel.

11. The article according to claim 1, wherein said middle layer is made of a transparent film.

12. The article according to claim 1, wherein said middle layer (4) is made of an opaque film.

* * * * *